US010111015B2

(12) United States Patent
Nielsen

(10) Patent No.: US 10,111,015 B2
(45) **Date of Patent: *Oct. 23, 2018**

(54) HEARING AID WITH INCREASED ACOUSTIC BANDWIDTH

(71) Applicant: Widex A/S, Lynge (DK)

(72) Inventor: Kim Hjortgaard Nielsen, Frederikssund (DK)

(73) Assignee: Widex A/S, Lynge (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/269,108

(22) Filed: Sep. 19, 2016

(65) Prior Publication Data

US 2017/0006388 A1 Jan. 5, 2017

Related U.S. Application Data

(63) Continuation of application No. 12/034,727, filed on Feb. 21, 2008, now Pat. No. 9,473,857, which is a (Continued)

(51) Int. Cl.
*H04R 25/00* (2006.01)
*H04R 1/24* (2006.01)
(Continued)

(52) U.S. Cl.
CPC ..... *H04R 25/505* (2013.01); *H04R 1/24* (2013.01); *H04R 25/405* (2013.01);
(Continued)

(58) Field of Classification Search
CPC . H04R 25/00; H04R 2225/49; H04R 2460/01
(Continued)

(56) References Cited

U.S. PATENT DOCUMENTS 4,548,082 A 10/1985 Engebretson
4,592,087 A 5/1986 Killion
(Continued)

FOREIGN PATENT DOCUMENTS

DE 1739043 U 2/1957
DE 2512343 A1 10/1976
(Continued)

OTHER PUBLICATIONS

European Office Action for EP05773800.7 dated May 29, 2008.
Japanese Office Action for JP2008-527306 dated Jan. 11, 2011.

*Primary Examiner* — Suhan Ni
(74) *Attorney, Agent, or Firm* — Sughrue Mion, PLLC

(57) ABSTRACT

A hearing aid (21) includes a signal processor producing signals that have been processed to compensate for a hearing impairment, a first output converter (26), a second output converter (27), a first acoustic output transducer (34) and at least a second output transducer (35). The first output converter (26) and the first output transducer (34) are configured to reproduce the high frequencies of the processed signals, and the second output converter (27) and the second output transducer (35) are configured to reproduce the low frequencies of the processed signals. The output converters (26, 27) may preferably be embodied as direct digital drive output converters. The processed signals are split between the first and second output converters according to a cross-over frequency tunable by programming.

21 Claims, 6 Drawing Sheets

Related U.S. Application Data continuation-in-part of application No. PCT/DK2005/000538, filed on Aug. 23, 2005.

(51) Int. Cl.
*H04R 1/22* (2006.01)
*H04R 3/12* (2006.01)
*H04R 3/14* (2006.01)

(52) U.S. Cl.
CPC ..... *H04R 25/407* (2013.01); *H04R 25/48* (2013.01); *H04R 25/70* (2013.01); *H04R 1/22* (2013.01); *H04R 3/12* (2013.01); *H04R 3/14* (2013.01); *H04R 2205/041* (2013.01)

(58) Field of Classification Search
USPC ..... 381/312–213, 316–318, 320–321
See application file for complete search history.

(56) References Cited

U.S. PATENT DOCUMENTS 4,629,833 A 12/1986 Kern et al.
4,882,762 A * 11/1989 Waldhauer ..... H03G 9/18 381/106
4,989,251 A 1/1991 Mangold
5,781,642 A * 7/1998 Tanaka ..... H04R 3/14 381/345
5,878,146 A 3/1999 Andersen
5,912,978 A 6/1999 Eastty et al.
6,044,162 A 3/2000 Mead et al.
6,072,885 A 6/2000 Stockham
6,115,478 A * 9/2000 Schneider ..... H04R 25/558 381/312
6,405,227 B1 6/2002 Prakash
7,321,661 B2 * 1/2008 Stanley ..... H04R 3/14 381/111
7,472,048 B2 12/2008 Puckette
7,929,714 B2 * 4/2011 Bazarjani ..... H04R 19/005 257/686
2002/0039428 A1 4/2002 Svajda et al.

FOREIGN PATENT DOCUMENTS

DE 3224614 A1 1/1984
JP 63300700 A 12/1988
JP 2013097 A 1/1990
JP 6054395 A 2/1994
JP 10164696 A 6/1998
JP 2003516003 T 5/2003
WO 9507014 A1 3/1995
WO 01/39546 A1 5/2001
WO 2005076664 A1 8/2005

* cited by examiner

HEARING AID WITH INCREASED ACOUSTIC BANDWIDTH

CROSS-REFERENCE TO RELATED APPLICATIONS

The present application is a continuation of U.S. application Ser. No. 12/034,727, filed Feb. 21, 2008, which is a continuation-in-part of application No. PCT/DK2005/000538, filed on Aug. 23, 2005, in Denmark and published as WO-A1-2007022773. The entire disclosure of the prior applications are considered part of the disclosure of the accompanying continuation application, and are hereby incorporated by reference.

BACKGROUND OF THE INVENTION

1. Field of the Invention

This invention relates to hearing aids. More specific, it relates to hearing aids with more than one acoustic output transducer. The invention also relates to a processor for a hearing aid.

Hearing aids essentially comprise a microphone for picking up acoustic sound waves and converting them into electrical signals, electronic circuitry for amplifying the electrical signals generated by the microphone, and an acoustic output transducer for reproducing the amplified electrical signals. The amplifier may favor certain frequency bands in the audio spectrum to other frequency bands according to a prescription in order to compensate for an individual hearing loss.

In this application, the term "high frequencies" preferably refers to audio frequencies between 3 kHz and 15 kHz, and the term "low frequencies" preferably refers to audio frequencies between 20 Hz and 3 kHz.

2. The Prior Art

Hearing aids may be used to alleviate very different hearing impairments. Some examples of a hearing impairment are loss of a narrow band of frequencies, loss of the high frequencies, loss of low frequencies, or a more evenly distributed hearing loss across the entire audio spectrum. In cases where some residual hearing is present in the affected frequency range a hearing aid user may benefit from a hearing aid with means to process these frequencies.

Present-day hearing aids have a limited high-frequency reproduction, usually capped at about 4-8 kHz, mainly due to limitations of the output transducer. For reasons in the mechanical interactions in the components, extension of the frequency range only comes against the cost of a reduced output power in the low frequency end, and a trade off needs to be found somewhere. Transducers for use in hearing aids are manufactured with focus on speech reproduction, and thus optimized for use in the 200 Hz-6 kHz frequency range, important for speech recognition. However, other sounds of interest, e.g. sounds originating from animals or machinery, are present in the 6 kHz-15 kHz range, too. Individuals with normal hearing are usually able to perceive sounds up to between 15 kHz and 20 kHz, and even persons with a profound hearing loss may still possess some ability to perceive sounds above and beyond 8 kHz, dependent on the individual nature of the hearing loss.

Recent studies have shown that hearing-impaired young children still having residual hearing left in the 6 kHz-15 kHz range may benefit from the availability of this frequency range when learning to speak. In speech, the main part of the fricative sonic energy of the so-called morphemes /s/ and /z/, i.e. the speech sounds "s" and "z", generally lies above 4 kHz, especially in the range of 4 kHz-8 kHz, and the ability to perceive and subsequently reproduce those sounds may be improved significantly if this frequency range is made available to hearing-impaired children under the circumstances mentioned earlier. A hearing aid having means to reproduce the frequency range from 200 Hz up to perhaps between 15 kHz and 20 kHz is thus desirable.

Dual acoustic transducers embodied as composite units are known. For instance, the EJ transducer series from Knowles Electronics, Inc. are dual magnetic receiver types configured for use in hearing aid applications. Such receivers comprise two essentially identical transducer units sandwiched together to form a single unit for use in a hearing aid. During manufacture, great care is taken in order to ensure that the two transducer units eventually perform as identically as possible with respect to their electrical and mechanical characteristics. Dual acoustic transducers are mainly used in applications where high sound pressure levels are required, for instance in high-power hearing aid applications.

U.S. Pat. No. 4,548,082 describes a hearing aid having two independently driven acoustic output transducers, denoted a woofer and a tweeter, respectively, for reproducing low-frequency and high frequency bands in the audible spectrum. The two acoustic output transducers are driven by a pair of sample-and-hold circuits, alternatingly sampling the output from a D/A converter for providing the acoustic output transducers with low-frequency and high-frequency sounds, respectively. The sample-and-hold circuits are controlled by a multiplexer providing the alternating signal feeds to the two acoustic output transducers. Optional anti-aliasing filters may be provided between the sample-and-hold circuits and the acoustic output transducers in order to filter out aliasing noises.

Although this approach provides means for driving more than one output transducer in a hearing aid, it also has some serious shortcomings. Driving an acoustic output transducer through a sample-and-hold circuit is very likely to introduce noise, and various spurious and aliasing effects, degrading the quality of the output and needing compensation.

SUMMARY OF THE INVENTION

The invention, in a first aspect, provides a hearing aid comprising a microphone, an input converter for receiving signals from the microphone, a signal processor, a first output converter, a second output converter, a first acoustic output transducer and a second acoustic output transducer, said signal process or being adapted for processing signals from the input converter in order to feed respective outputs to said first output converter and said second output converter, wherein said first output converter and said first output transducer are configured to reproduce the high frequencies of the processed signals, wherein said second output converter and said second output transducer are configured to reproduce the low frequencies of the processed signals, and wherein said signal processor has frequency selection means adapted to split the outputs according to a cross-over frequency tuned by programming.

This gives the hearing aid the capability of reproducing a wider frequency range than a hearing aid having one output transducer, without the inherent problems of multiplexing the signals for the two output transducers in order to separate the frequency bands.

According to an aspect of the invention, the first and the second acoustic output transducers are embodied as a single physical unit. The individual transducers making up the unit are configured differently in accordance with the frequency ranges they are intended to reproduce, respectively. The first output transducer is configured to reproduce the high frequencies, and the second output transducer is configured to reproduce the low frequencies.

The configuration of the output transducers may be carried out at the design stage by adjusting selected dimensions of the individual output transducers, by adapting the physical features, dimensions or electrical parameters to suit the application, or by other suitable means known in the art.

The invention, in a second aspect, provides a processor a processor for a hearing aid comprising an input converter for receiving signals from a microphone, a first output terminal, a second output terminal, means for processing signals from the input converter according to a prescription so as to produce a processed digital output signal, a first output converter configured for reproducing at a first output terminal a first frequency portion of the processed signal, a second output converter configured for reproducing at a second output terminal a second frequency portion of the processed signal, and frequency selection means for splitting the digital output signal into a first digital output signal suitable for driving the first output converter to reproduce the high frequency portion of the processed signal, and a second digital output signal suitable for driving the second output converter to reproduce the low frequency portion of the processed signal, said frequency selection means being adapted to split the processed outputs according to a crossover frequency tuned by programming.

Further features and embodiments will appear from the dependent claims.

BRIEF DESCRIPTION OF THE DRAWINGS

The invention will now be described in further detail with reference to the drawings, where.

DETAILED DESCRIPTION OF THE INVENTION

Figure 1:
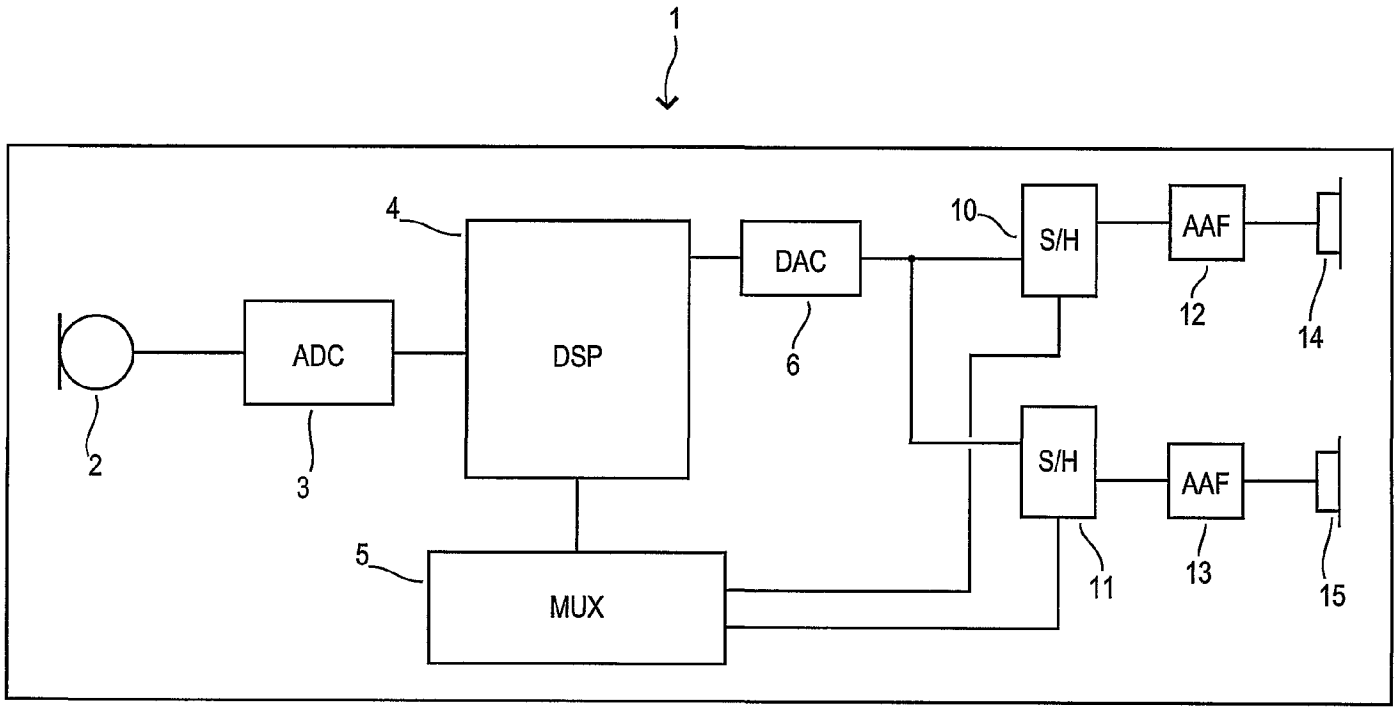
PRIOR ART Fig. 1
FIG. 1 is a schematic showing a prior art hearing aid.

FIG. 1 is a schematic showing a prior art hearing aid 1 comprising a microphone 2, an analog-to-digital converter (ADC) 3, a digital signal processor (DSP) 4, a multiplexer (MUX) 5, a digital-to-analog converter (DAC) 6, a first sample-and-hold block 10, a second sample-and-hold block 11, a first anti-aliasing filter block 12, a second anti-aliasing filter block 13, a first output transducer 14, dedicated to reproducing high frequencies, and a second output transducer 16, dedicated to reproducing the low frequencies, ref. U.S. Pat. No. 4,548,082.

Analog acoustic signals are picked up by the microphone 2 and converted into digital signals by the ADC 3. The digital signals from the ADC 3 are then presented to the input of the DSP 4 for further processing and amplification according to a prescribed alleviation scheme in order to compensate for a detected hearing loss. The output signals from the DSP 4 are converted into analog signals by the DAC 6 and the analog output signals from the DAC 6 are then fed in parallel to the inputs of the first sample-and-hold block 10 and the second sample-and-hold block 11. The sample-and-hold blocks 10, 11 are controlled by the MUX 5, which in turn is controlled by the DSP 4.

The MUX 5 alternatingly opens one of the sample-and-hold blocks 10, 11 for passing signals from the DAC 6 in such a way that high frequencies are passed from the first sample-and-hold block 10 via the first anti-aliasing filter 12 to the first output transducer 14, and low frequencies are passed from the second sample-and-hold block 11 via the second anti-aliasing filter 13 to the second output transducer 15. The DSP 4 coordinates its output to the DAC 6 with its control signals to the MUX 5 in such a way that high-frequency signals are passed to the first output transducer 14 and low-frequency signals are passed to the second output transducer 15.

The prior art hearing aid 1 thus reproduces audio signals by alternatingly driving the first output transducer 14 and the second output transducer 15 carrying low-frequency audio signals and high-frequency signals, respectively. The alternation frequency with which the MUX 5 controls the first and second sample-and-hold blocks 10, 11 has to be above the highest audible frequency reproduced by the first output transducer 14 in order to be able to reproduce continuous signals. This means that the timing values of the MUX 5 have to meet very exact tolerances in order to prevent drop-outs or audible artifacts originating from the alternating switching process from reaching the output transducers 14, 15.

Figure 2:
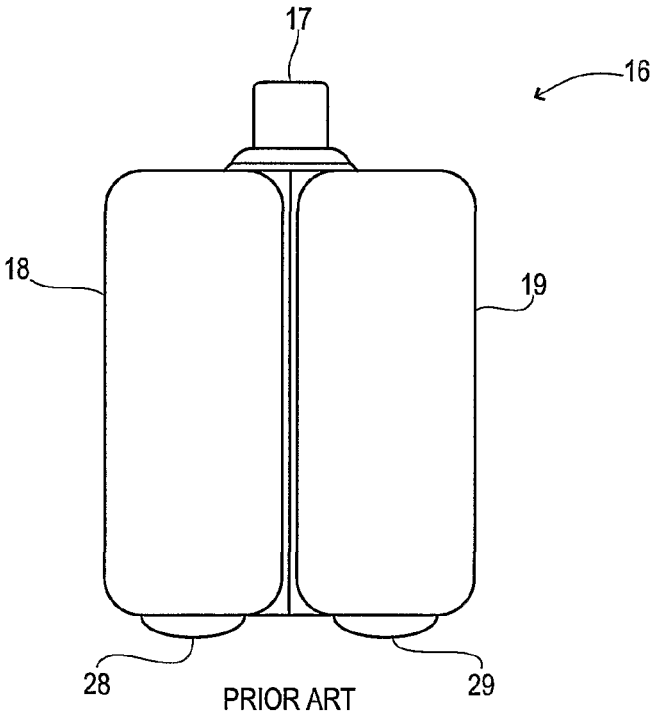
FIG. 2 shows a prior art double-output transducer.

FIG. 2 shows a prior art acoustic output transducer unit 16 for a hearing aid comprising a sound outlet 17, a first electroacoustic transducer 18 having a first set of electrical connecting terminals 28, and a second electroacoustic transducer 19, having a second set of electrical connecting terminals 29 (Knowles Electronics EJ). When connected to e.g. hearing aid circuitry (not shown), electrical signals entering the electrical connecting terminals 28, 29 are converted into corresponding acoustical signals in the electroacoustic transducers 18, 19. The acoustical signals from the electroacoustic transducers 18, 19 are output from the sound outlet 17.

The electroacoustic transducers 18, 19 of the prior art output transducer 16 are essentially identical. When the same electrical signal is applied to the electrical connecting terminals 28, 29, it may cause the membrane (not shown) of the first electroacoustic transducer 18 and the second electroacoustic transducer 19 to move in the same direction. The effective membrane area is thus doubled, resulting in an acoustic output transducer which is more power-efficient than a single electroacoustic transducer having a double-sized membrane. In order for the frequency response of the prior art output transducer 16 to be as smooth as possible, great care is taken during manufacture to render the electroacoustic transducers 18, 19 as similar as possible with regard to production parameters affecting the quality of the sound reproduction, as mentioned in the foregoing.

Figure 3:
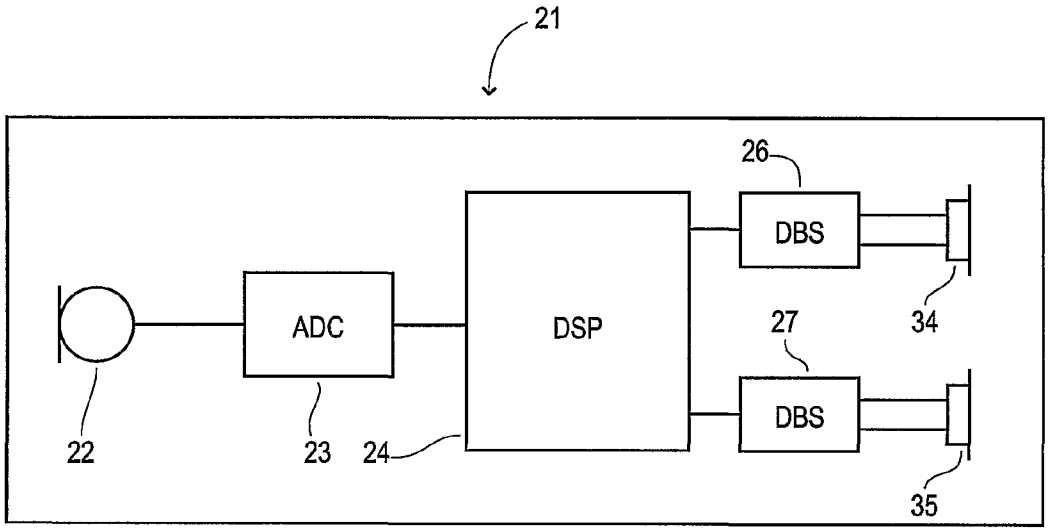
FIG. 3 is a schematic showing a hearing aid according to the invention.

FIG. 3 shows a hearing aid 21 according to the invention. The hearing aid 21 comprises a microphone 22, an analog-to-digital converter (ADC) 23, a digital signal processor (DSP) 24, a first digital bit stream output stage (DBS) 26, a second digital bit stream output stage (DBS) 27, a first acoustic output transducer 34, dedicated to the reproduction of high frequencies, and a second output transducer 35, dedicated to the reproduction of low frequencies.

Analog acoustic signals are picked up by the microphone 22 and converted into digital signals by the ADC 23. The digital signals from the ADC 23 are then presented to the input of the DSP 24 for further processing and amplification according to a prescribed alleviation scheme in order to compensate for a detected hearing loss. The DSP 24 has means (not shown), essentially in the form of suitable software algorithms, for dividing the digital signals into high-frequency and low frequency digital signal parts, and means (not shown) for presenting the high frequency parts of the signals to a first output terminal and the low frequency parts of the signals to a second output terminal.

The digital output signals from the first and second output terminals of the DSP 24 are converted into two serial digital bit streams by the first DBS 26 and the second DBS 27. The bit stream from the first DBS 26, originating from the first output terminal of the DSP 24 and thus, by definition, comprising the high frequencies of the signals, is used as the input signal for the first output transducer 34, and the bit stream from the second DBS 27, originating from the second output terminal of the DSP 24 and thus, by definition, comprising the low frequencies of the signals, is used as the input signal for the second output transducer 35.

The digital bit streams, having a basic frequency in the magnitude of 1 MHz, are capable of driving the output transducers 34, 35 directly as the driver coils (not shown) present in the output transducers 34, 35 filter away the drive frequency, limiting the acoustic output bandwidth in the output transducers 34, 35 to about 15-20 kHz. The output transducers thus make up part of the electrical output stage, essentially being driven as a class D digital output amplifier. This approach is very economical in terms of chip area demands and power consumption. Further details about the design of such output stages may be found in U.S. Pat. No. 5,878,146. A more advanced digital output stage, also suitable for use in combination with the invention, is the subject of an international application PCT/DK 2005/000077, filed on 4 Feb. 2005, and published as WO-A1 2005076664, counterpart of US-A1-20070036375.

In use, the hearing aid 21 receives acoustic signals via the microphone 22 and converts them into digital signals with the aid of the ADC 23. The digital signals from the ADC 23 are processed by the DSP 24, amplified and compressed according to a prescription for alleviating a hearing loss, and separated into two independent digital output signals. The DSP 24 coordinates the digital output signals to the first and the second DBS 26, 27 in order for the analog output signals of the output transducers 34, 35 to be mutually coherent.

The acoustic output transducers 34, 35 may be configured differently in order to most effectively cover the desired frequency spectrum distributed between them. The first output transducer 34 may be configured to favor frequencies above a selected crossover frequency and thus primarily reproduce the high frequencies of the output signal, and the second output transducer 35 may be configured to favor frequencies below a selected crossover frequency and primarily reproduce the low frequencies of the output signal. The crossover frequency is selected based on the acoustic characteristics of the output transducers 34, 35 and programmed into the DSP 24.

Programming operations to enter the selected cross-over frequency into the processor may take place during manufacturing of the electronics module of the hearing aid or later, e.g. during a hearing aid fitting session.

Figure 4:
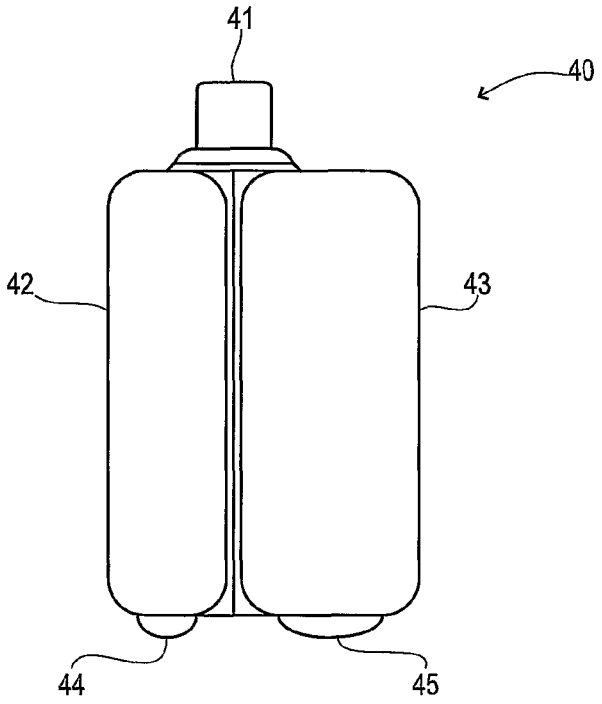
FIG. 4 shows a double-output transducer for use with the invention.

FIG. 4 shows an acoustic output transducer unit 40 for a hearing aid according to the invention comprising a sound outlet 41, a first electroacoustic transducer 42, a second electroacoustic transducer 43, a first set of electrical connecting terminals 44, and a second set of electrical connecting terminals 45. When connected to the hearing aid circuitry (not shown), electrical signals entering the electrical connecting terminals 44, 45 are converted into corresponding acoustical signals in the electroacoustic transducers 42, 43. The acoustical signals from the electroacoustic transducers 42, 43 are output from the sound outlet 41.

The first electroacoustic transducer 42 is configured to reproduce the upper part of the audio spectrum and the second electroacoustic transducer 43 is configured to reproduce the lower part of the audio spectrum. The first electroacoustic transducer and the second electroacoustic transducer are mechanically integrated into one unit, so as to facilitate handling of parts and assembly of the hearing aid.

Figure 5:
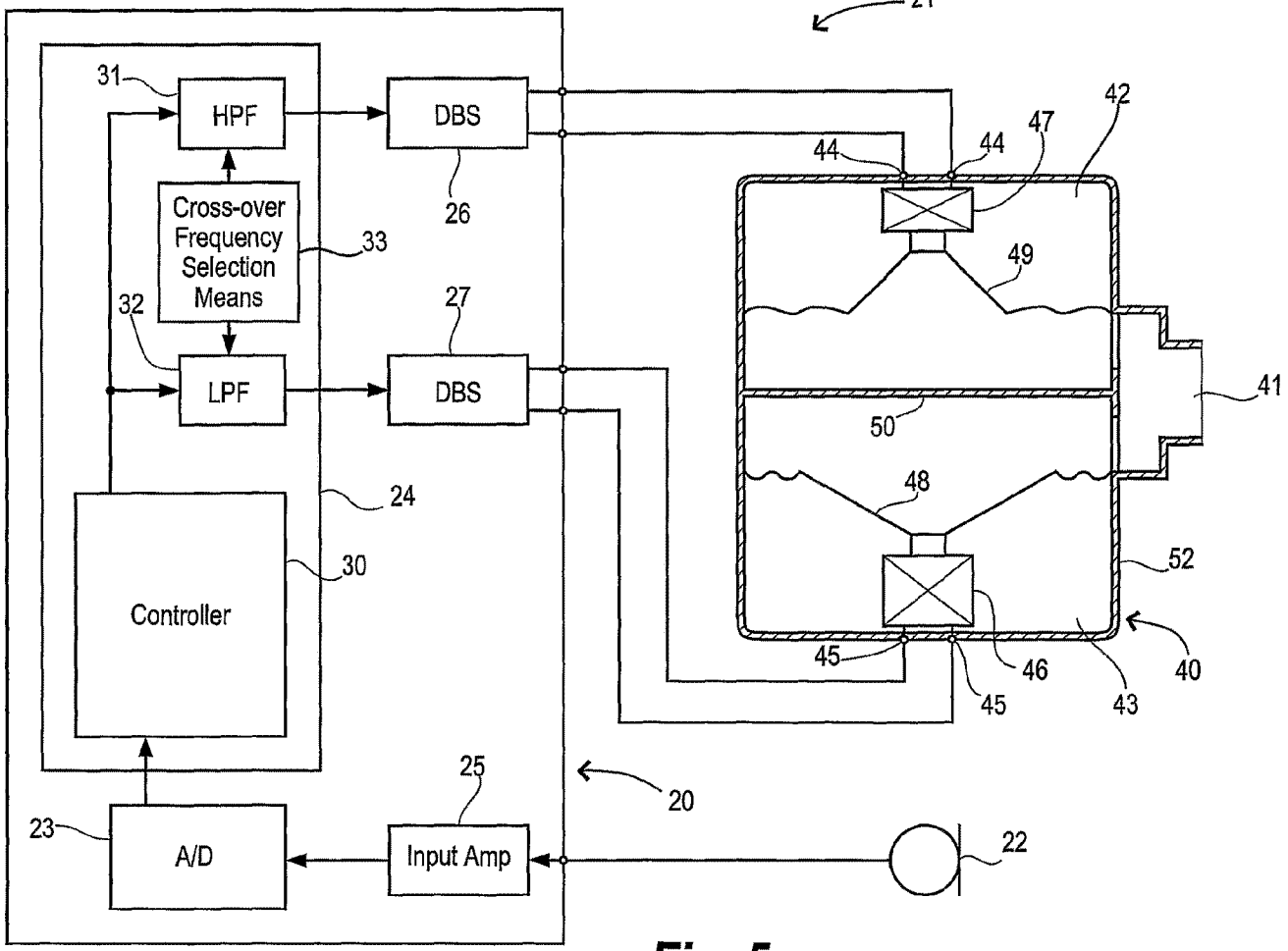
FIG. 5 is a schematic of a hearing aid according to the invention.

FIG. 5 is a schematic of a hearing aid 21 comprising a microphone 22, an electronics module 20, and an output transducer unit 40. The electronics module comprises an input amplifier 25, an A/D converter 23, a digital signal processor 24, a first digital bit stream output stage (DBS) 26, a second digital bit stream output stage (DBS) 27, and means 33 for selecting a cross-over frequency. The digital signal processor 24 comprises a controller 30, a high-pass filter (HPF) 31, and a low-pass filter (LPF) 32.

The output transducer unit 40 comprises an outer shell 52, a first set of inputs 44, a second set of inputs 45, a first transducer 42 comprising a first transducer coil 47 and a first transducer membrane 49, a second transducer 43 comprising a second transducer coil 46 and a second transducer membrane 48, a separating wall 50 of the shell 52 separating the first transducer 42 from the second transducer 43, and a common sound outlet 41.

The microphone 22 of the hearing aid 21 picks up sound signals of the entire useable frequency range from about 20 Hz to approximately 15 kHz and converts the sound signals into electrical signals which are presented to the input of the input amplifier 25. The amplified electrical signals from the input amplifier 25 are converted into digital signals in the analog-to-digital (A/D) converter 23 for further processing by the DSP 24.

The digital signals from the A/D converter 23 are presented to the controller 30 of the DSP 24. The controller 30 performs amplification, compression and conditioning of the digital signals according to a prescription scheme in order to alleviate a hearing loss. The controller 30 of the DSP 24 presents the resulting digital output signals to the HPF 31 and the LPF 32. The output of the HPF 31 is presented to the first DBS 26, and the output of the LPF 32 is presented to the second DBS 27. The cross-over frequency selection means 33 are connected to the HPF 31 and the LPF 32 for selecting a cross-over frequency from a plurality of available cross-over frequencies determining at which frequency the cut-off frequencies for the HPF 31 and the LPF 32 is to be set.

The output signals from the first DBS 26 are fed to the first transducer coil 47 of the first output transducer 42 via the first set of input terminals 44, and the output signals from the second DBS 27 are fed to the second transducer coil 46 of the second output transducer 43 via the second set of input terminals 45. The first transducer coil 47 drives the first transducer membrane 49, converting the electrical output signals from the first DBS 26 into acoustical signals for the sound outlet 41. In a similar manner, the second transducer coil 46 drives the second transducer membrane 48, converting the electrical output signals from the second DBS 27 into acoustical signals for the sound outlet 41.

The signal path comprising the HPF 31 of the DSP 24, the first DBS 26, the first output transducer 42 and the sound outlet 41, is essentially configured to reproduce the frequencies above the selected cross-over frequency, and the signal path comprising the LPF 31 of the DSP 24, the second DBS 27, the second output transducer 43 and the sound outlet 41, is essentially configured to reproduce the frequencies below the selected cross-over frequency. The first transducer membrane 49 and the second transducer membrane 48 are mechanically separated by the separating wall 50 in order to ensure independency and efficiency in reproducing the separate frequency bands.

The entire reproduced acoustical sound spectrum output from the sound outlet 41 thus comprises a high band and a low band of frequencies separated by the cross-over frequency and combined at the sound outlet 41. This enables the first output transducer 42 and the second output transducer 43 to be optimized for reproducing the separate parts of the acoustical sound spectrum.

In one embodiment, the first output transducer 42 is optimized to reproduce frequencies above, say, 2.7 kHz with a roll off of frequencies below 2.7 kHz, while the second output transducer 43 is optimized to reproduce frequencies below 2.7 kHz with a roll off of frequencies above 2.7 kHz, while a cross-over frequency of 2.7 kHz is programmed into the cross-over frequency selection means 33. Such optimizations may be achieved by adjusting the physical dimensions and materials and other relevant parameters of the individual transducers 42, 43 during design and manufacture of the transducer unit 40. The benefits of the optimizations are an improved capability of the transducer unit 40 to reproduce frequencies above 5-6 kHz without adversely affecting reproduction of frequencies below 2-3 kHz significantly.

Figure 6:
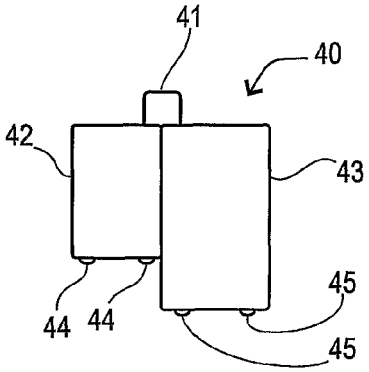
FIG. 6 is an embodiment of a double-output transducer for use with the invention.

FIG. 6 shows an embodiment of a double-transducer arrangement 40 for use with the invention. It comprises a first transducer 42 having a first set of input terminals 44, a second output transducer 43 having a second set of input terminals 45, and a common sound outlet 41. The first transducer 42 is attached to the second transducer 43 on one of its long sides in such a way that the first transducer 42 and the second transducer 43 may share the common sound outlet 41. The first transducer 42 is somewhat shorter in length in comparison with the second transducer 43 in order to facilitate reproduction of higher frequencies, and the first set of input terminals 44 of the first output transducer 42 are thus placed further into the double-transducer arrangement 40 than the second set of terminals 45 of the second transducer 43.

Figure 7:
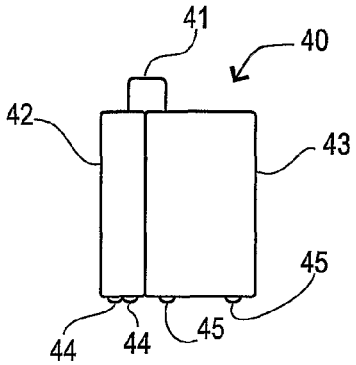
FIG. 7 is an alternate embodiment of a double-output transducer for use in the invention.

FIG. 7 shows an alternate embodiment of a double-transducer arrangement 40 for use with the invention. It comprises a first transducer 42 having a first set of input terminals 44, a second output transducer 43 having a second set of input terminals 45, and a common sound outlet 41. The first transducer 42 is attached to the second transducer 43 on one of its long sides in such a way that the first transducer 42 and the second transducer 43 may share the common sound outlet 41. The first transducer 42 is somewhat narrower than the second transducer 43 in order to facilitate reproduction of higher frequencies, and the first set of input terminals 44 of the first output transducer 42 are thus aligned with the second set of terminals 45 of the second transducer 43.

Figure 8:
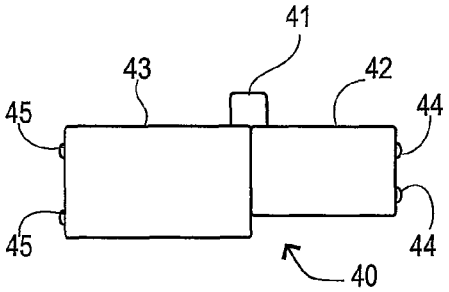
FIG. 8 is an alternate embodiment of a double-output transducer for use in the invention.

FIG. 8 shows an alternate embodiment of a double-transducer arrangement 40 for use with the invention. It comprises a first transducer 42 having a first set of input terminals 44, a second output transducer 43 having a second set of input terminals 45, and a common sound outlet 41. The first transducer 42 is attached to the second transducer 43 on one of its short sides in such a way that the first transducer 42 and the second transducer 43 may share the common sound outlet 41. The first transducer 42 is somewhat shorter in length in comparison with the second transducer 43 in order to facilitate reproduction of higher frequencies, and the first set of input terminals 44 of the first transducer 42 are thus placed opposite the second set of input terminals 45 of the second transducer 43.

Figure 9:
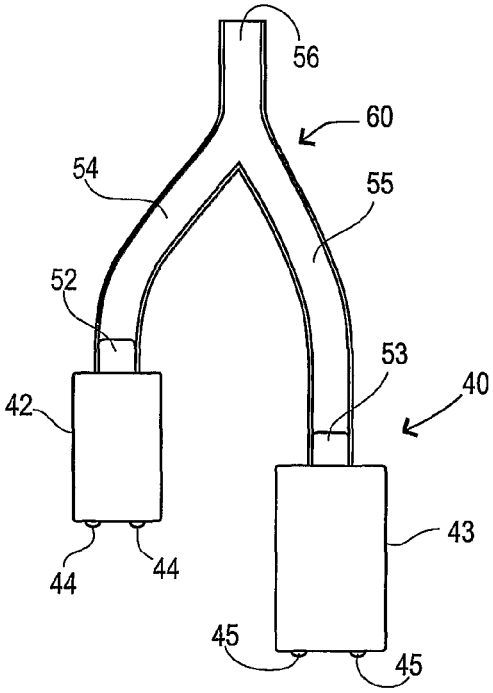
FIG. 9 is an embodiment of a separate double-output transducer configuration with common conduit for use in the invention.

FIG. 9 shows an alternate embodiment of a double-transducer arrangement 40 for use with the invention. It comprises a first transducer 42 having a first set of input terminals 44 and a first sound outlet 52, a second output transducer 43 having a second set of input terminals 45 and a second sound outlet 53, and an essentially Y-shaped conduit element 60 comprising a first conduit 54 for connecting matingly to the first sound outlet 52 of the first transducer 42, a second conduit 55 for connecting matingly to the second outlet 53 of the second transducer 43, the first conduit 54 and the second conduit 55 merging to form a common conduit 56 making up a common sound outlet of the double-transducer arrangement 40 of FIG. 9.

In the embodiment shown in FIG. 9, the transducers 42, 43 may be more liberally disposed in the hearing aid in comparison with the embodiments shown in FIGS. 6, 7 and 8. This may be an advantage in certain situations where the space available in the hearing aid shell is limited. The first conduit 54 and the second conduit 55 of the conduit element 60 may also be adapted specifically to the characteristics of the transducers 42, 43 so as to further optimize sound reproduction from the double-transducer arrangement 40.

I claim:

1. A hearing aid comprising:

a digital signal processor configured to process a digital signal according to a prescription scheme in order to alleviate a hearing loss, and to output processed signals to:

a first digital output stage having a first acoustic output transducer for reproducing low frequencies of the processed signals, and a second digital output stage having a second acoustic output transducer for reproducing high frequencies of the processed signals;

wherein the signal processor has a frequency selection component operable on the processed signals to split the processed signals according to a cross-over frequency into the first and the second digital output stage; and wherein the cross-over frequency is set by programming.

2. The hearing aid according to claim 1, wherein the first and second acoustic output transducers make up parts of the respective first and second digital output stages and are essentially driven as class D digital output amplifiers.

3. The hearing aid according to claim 1, wherein the first and the second acoustic output transducers are embodied as a single physical unit.

4. The hearing aid according to claim 1, wherein the cross-over frequency is selected to match the configuration of said first and said second acoustic output transducers.

5. The hearing aid according to claim 1, wherein the cross-over frequency is tunable by programming during manufacturing of said hearing aid.

6. The hearing aid according to claim 1, wherein the cross-over frequency is tunable by programming when fitting the hearing aid.

7. The hearing aid according to claim 1, wherein the frequency selection component is connected to a high-pass filter and a low-pass filter for selecting a cross-over frequency from a plurality of available cross-over frequencies determining at which frequency the cut-off frequencies for the high-pass filter and low-pass filter is to be set.

8. The hearing aid according to claim 1, wherein the cross-over frequency is tunable by programming to select from amongst a plurality of selectable cross-over frequencies.

9. The hearing aid according to claim 1, wherein the cross-over frequency is selected based on the acoustic characteristics of the output transducers and programmed into the digital signal processor.

10. The hearing aid according to claim 1, wherein the cross-over frequency is stored in a memory by programming and applied by the frequency selection component for splitting the processed signals from the digital signal processor.

11. A method of configuring a hearing aid, wherein the hearing aid has a digital signal processor processing a digital signal according to a prescription scheme in order to alleviate a hearing loss, and outputting the processed signals to a first digital output stage having a first acoustic output transducer for reproducing low frequencies of the processed signals, and a second digital output stage having a second acoustic output transducers for reproducing high frequencies of the processed signals; comprising steps of:

splitting according to a cross-over frequency the signals processed by the signal processor into the first and the second digital output stage; and tuning the cross-over frequency by programming.

12. The method according to claim 11, comprising driving the output transducers essentially as class D digital output amplifiers by configuring the output transducers as parts of the respective digital output stages.

13. The method according to claim 11, wherein tuning the cross-over frequency by programming is performed during manufacturing of an electronics module of the hearing aid.

14. The method according to claim 11, wherein tuning the cross-over frequency by programming is performed during a hearing aid fitting session.

15. The method according to claim 11, wherein tuning the cross-over frequency by programming is comprises selecting a cross-over frequency from a plurality of available cross-over frequencies.

16. The method according to claim 11, comprising storing the cross-over frequency in a memory, and applying the cross-over frequency by the frequency selection component for splitting the processed signals from the digital signal processor.

17. A method of configuring a hearing aid, wherein the hearing aid has a digital signal processor processing a digital signal according to a prescription scheme in order to alleviate a hearing loss, and splitting the processed signals into two digital output stages according to a cross-over frequency, wherein the two digital output stages have respective acoustic output transducers for reproducing the processed signals at low and high frequencies, respectively; the method comprising steps of:

manufacturing an electronics module of the hearing aid; and tuning the cross-over frequency by programming.

18. The method according to claim 17, comprising driving the output transducers essentially as class D digital output amplifiers by configuring the output transducers as parts of the respective digital output stages.

19. The method according to claim 17, comprising programming the cross-over frequency during a hearing aid fitting session.

20. The method according to claim 17, comprising storing the cross-over frequency in a memory, and applying the cross-over frequency by the frequency selection component for splitting the processed signals from the digital signal processor.

21. A hearing aid comprising:

a signal processor configured to process a sound signal to compensate for a hearing impairment, and to output processed signals;

a first output stage reproducing low frequencies of the processed signals, and a second output stage for reproducing high frequencies of the processed signals;

wherein the signal processor has a selection component operable on the processed signals to split the processed signals between the first and second output stages according to a programmable cross-over frequency.

* * * * *